US006966151B1

(12) United States Patent
Harbers, Jr.

(10) Patent No.: US 6,966,151 B1
(45) Date of Patent: Nov. 22, 2005

(54) MANIPULABLE DOOR BARRIER ESCAPE APPARATUS AND METHOD

(75) Inventor: Henry C. Harbers, Jr., Templeton, CA (US)

(73) Assignee: Atoll Holdings, Inc., San Luis Obispo, CA (US)

( * ) Notice: Subject to any disclaimer, the term of this patent is extended or adjusted under 35 U.S.C. 154(b) by 0 days.

(21) Appl. No.: 10/438,634

(22) Filed: May 14, 2003

(51) Int. Cl.[7] ..... E06B 3/00; E05F 9/00; E05F 11/24; E05B 65/10

(52) U.S. Cl. ..... 49/506; 49/356; 49/338; 49/141; 292/92; 292/280

(58) Field of Search ..... 49/333, 324, 335, 49/338, 356, 141, 506; 292/92, 280, 279, 292/259 R, DIG. 65; 16/412, 110.1, 429, 16/436, 438, DIG. 7, DIG. 5

(56) References Cited

U.S. PATENT DOCUMENTS

| | | | | |
|---|---|---|---|---|
| 145,844 | A | | 12/1873 | Chipley |
| 213,327 | A | | 3/1879 | Foley |
| 237,316 | A | | 2/1881 | Pinckney |
| 269,377 | A | | 12/1882 | Bessier |
| 487,395 | A | | 12/1892 | Mannheim |
| 652,621 | A | | 6/1900 | LePore |
| 1,070,358 | A | * | 8/1913 | Smyser ..... 49/335 |
| 1,210,341 | A | * | 12/1916 | Matthews et al. ..... 49/324 |
| 1,914,889 | A | | 6/1933 | Lugara |
| 1,975,739 | A | * | 10/1934 | Ward ..... 49/356 |
| 2,078,146 | A | | 4/1937 | Le Blanc |
| 2,210,182 | A | | 8/1940 | Schultz et al. |
| 2,236,019 | A | | 3/1941 | Thompson |
| 2,840,289 | A | | 6/1958 | Murray |
| 3,017,956 | A | | 1/1962 | Corlett |
| 3,847,246 | A | | 11/1974 | Banner |
| 3,874,632 | A | | 4/1975 | Rago |
| 3,961,660 | A | * | 6/1976 | Vinci ..... 49/356 |
| 4,164,095 | A | * | 8/1979 | Musacchia ..... 49/141 |
| 4,520,900 | A | | 6/1985 | Orgeron |
| 4,919,235 | A | | 4/1990 | DelSavio |
| 5,064,021 | A | | 11/1991 | Bauer |
| 5,101,935 | A | | 4/1992 | LaBianca |
| 5,303,799 | A | | 4/1994 | Tsai |
| 5,562,184 | A | | 10/1996 | Yung-Ho |
| 5,620,058 | A | | 4/1997 | Forrester |
| 5,785,147 | A | | 7/1998 | Lee |
| 6,186,276 | B1 | | 2/2001 | Harbers, Jr. |
| 6,267,260 | B1 | * | 7/2001 | Lyons ..... 220/212.5 |
| 6,328,129 | B1 | | 12/2001 | Ferguson |

* cited by examiner

*Primary Examiner*—Hugh B. Thompson, II
(74) *Attorney, Agent, or Firm*—William W. Haefliger

(57) ABSTRACT

A building escape system, method and apparatus employs a door as both the egress opening from the building, and as the structural member to support the escapee during descent.

17 Claims, 12 Drawing Sheets

12
40
40a
15
41
19
20
18
11
45
57
26
30
22
23
27
23a
25
24
22a
13
32
31
10
33
16
41
40b 23
23a
11
10
12a
22
24
26
12

113
102a
110
109
102
108
107
105
103
103a
112

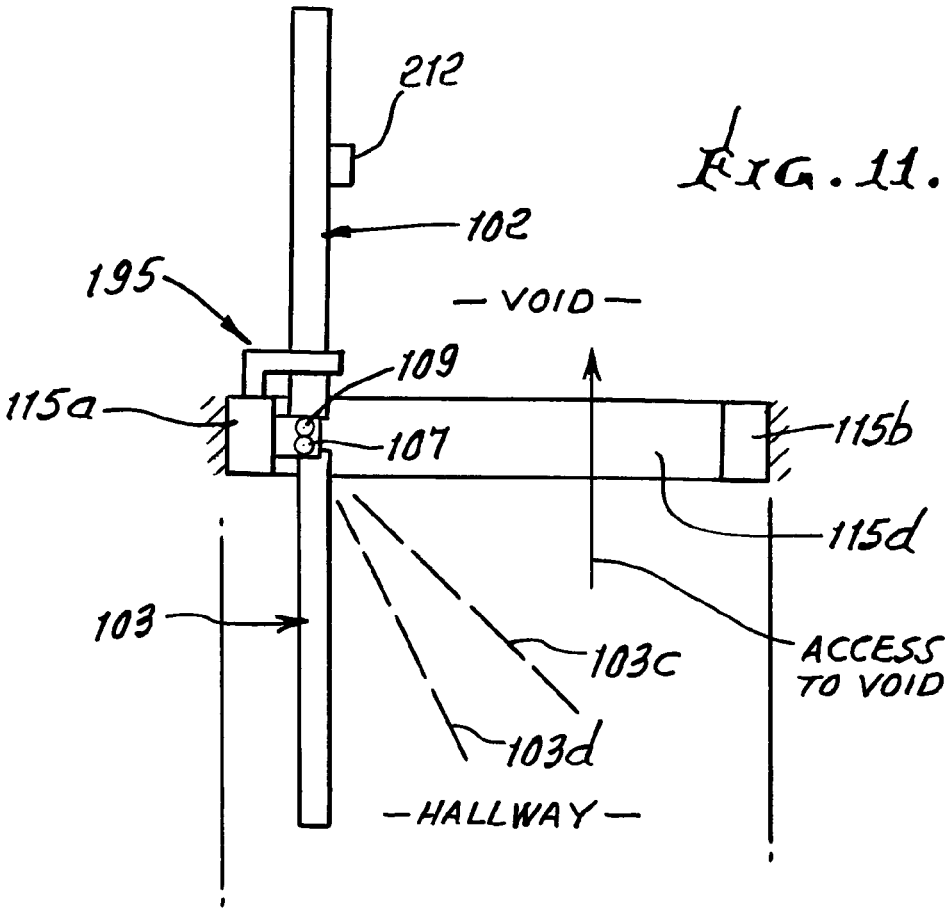
FIG. 11.
FIG. 12.
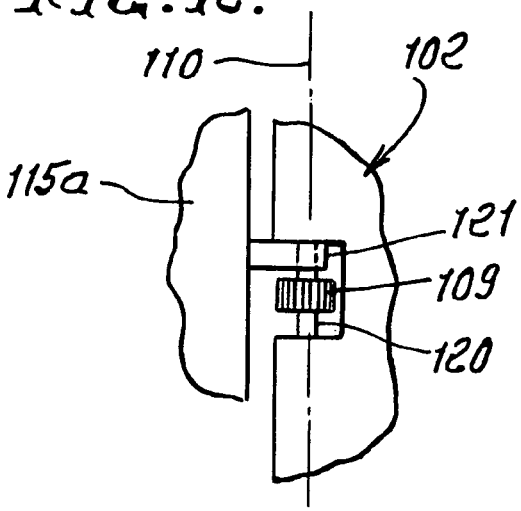
FIG. 13.
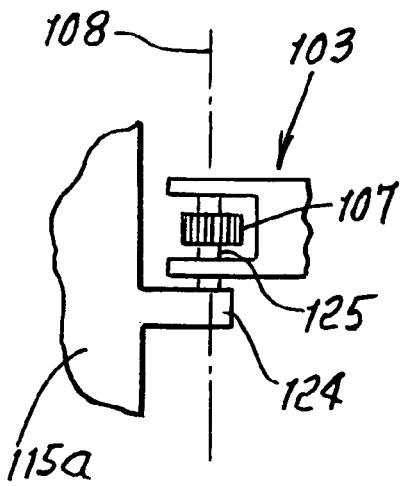

MANIPULABLE DOOR BARRIER ESCAPE APPARATUS AND METHOD

BACKGROUND OF THE INVENTION

This invention relates generally to method and means for escaping from a building, at the outer side of the building, and more particularly to provision of a multi-functional door serving when closed to block escape from the building interior at an upper elevation, and when open to allow escape from the building as via suspending of a person being lowered to a safe level.

There is continual need for improvements in escape methods and apparatus, enabling a person on an upper floor of the building to safely escape, as in case of fire. This need is acute when a fire prevents downward escape at the building interior, and where there are no fire escape steps attached to the exterior of the building.

SUMMARY OF THE INVENTION

It is a major object to provide a highly useful and simple method and apparatus to enable such escape, and downward travel at the building exterior. Basically, a multi-functional safety door is provided at an upper level or upper floor level of the building, the door located at the side of the building to be swung open in a novel manner for opening the way to escape from the building, allowing suspending of a person being lowered to safe level. The method includes the steps:

a) providing a bar at one side of the door, b) providing means operatively connecting the bar to the door so that the door opens when the bar is swung, c) and pivotally swinging the bar in a rearward direction away from the door so as to cause the door to swing forwardly toward open position, and while remaining substantially vertical.

Another object includes provision of a holder operating to hold the door in open position projecting away from the building wall, despite wind loading on the open door.

A further object includes provision of a casement to be carried by the building wall, the casement defining a door opening that is closed by the door before the bar is swung, and that is opened in response to bar swinging, rearwardly. The casement may be connected to the building wall, for example, and may carry the door and bar, as a unit.

Yet another object is to provide gearing operatively connected to the door and to the casement so as to swing the door forwardly as the bar is swung rearwardly and in a generally horizontal plane. Such gearing may advantageously include two meshing spur gears having vertical axes of rotation, one gear carried by the bar and the other carried by the door.

An additional object is to provide a protective barrier which has a position extending crosswise of the casement opening during swinging of the door toward its open position, to block user egress through the casement opening until the user is prepared for safe descent after egress through that opening.

An added object is to provide a second bar closely associated with the first bar prior to its rearward direction swinging. The second bar may advantageously be pivoted to swing independently relative to a casement defining a door opening that has been opened by the door, thereby allowing the user to egress through the casement opening. Further, the second bar may advantageously be at least partially confined by the first bar prior to door opening, so that the second bar remains in position to act as a barrier in registration with said opening, as the first bar is swung rearwardly to forwardly open the door. As will be seen, a spring may be provided to yieldably urge the second bar toward its barrier position.

A yet further object is to provide a protective but frangible layer extending over an outer side of the casement and over the outer side of the door, whereby opening of the door causes the layer to be broken at gaps between the door periphery and the casement.

A yet further object is to provide descent enabling means carried by the door to support a person to descend relative to the open door. As will be seen, a descent means typically includes a line to be hung from the door in open position. Also, a carrier may be supported by that line, the carrier capable of traveling downwardly along and relative to that line. A kinetic energy dissipating device may be associated with the carrier for slowing descent of the carrier travel on and along the line. Also, an excess weight warning device may be provided to be responsive to weight of the line and of a user or users descending via said line, to warn when weight applied to the door by the line and user or users exceeds a predetermined limit, whereby intending users are warned not to descend until such warning is removed by removal of a descending user or users from the line.

A yet added object is to provide a second line, and to also provide for spooling of said descent line and second line at or proximate the door whereby when either of such lines is pulled downwardly from a lower level, the other of the lines is pulled upwardly toward the door, whereby a rescuer may be carried upwardly by that other line toward the door.

Additional objects include provision, in combination, of a) a casement defining an opening, b) a door pivotally carried by the casement to alternately open and close the opening as the door is pivotally swung, c) and a first bar operatively connected to the door and casement to swing the door forwardly for opening said casement opening in response to rearward swinging of the bar.

Two meshing spur gears may be provided to have vertical axes, one gear carried by the door and the other gear carried by the bar, to rotate the one gear and door clockwise as the other gear and bar are rotated counterclockwise. A second bar may be carried by the casement to act as a barrier to user egress through said casement opening while the first bar is swung rearwardly, the bar then being independently swingable rearwardly to allow user egress through said opening; and the second bar may be at least partly confined by the first bar, prior to opening of the door, for enhanced safety.

These and other objects and advantages of the invention, as well as the details of an illustrative embodiment, or embodiments, will be more fully understood from the following specification and drawings, in which:

DRAWING DESCRIPTION

FIG. 4 is a plan view taken on lines 4—4 of FIG. 1;

FIG. 11 is a view like FIG. 8, but showing a fully open door, and a fully swung bar;

FIGS. 12 and 13 are fragmentary sections showing door and bar support;

DETAILED DESCRIPTION

Figure 1:
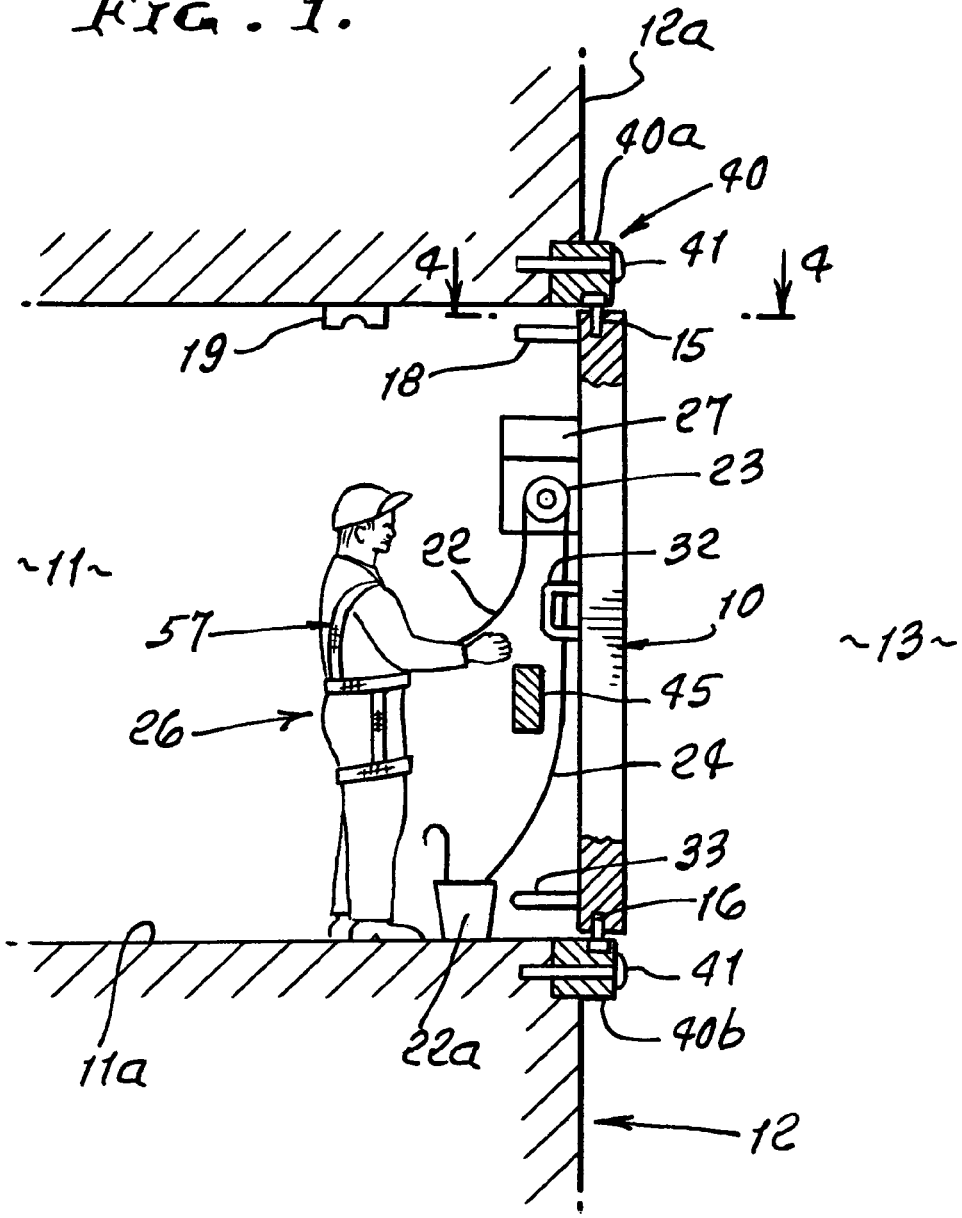
FIG. 1 is a side elevation showing a safety door in closed position.

Referring first to FIG. 1, and as also described in my pending application Ser. No. 09/883,160, a safety door 10 is shown in closed position, at the end of a passage 11 in a building 12. The passage also appears in FIGS. 2 and 3. The door closes off the passage from the building exterior 13, and it may extend upwardly from a level at or proximate the passage floor level 11*a*.

Figure 2:
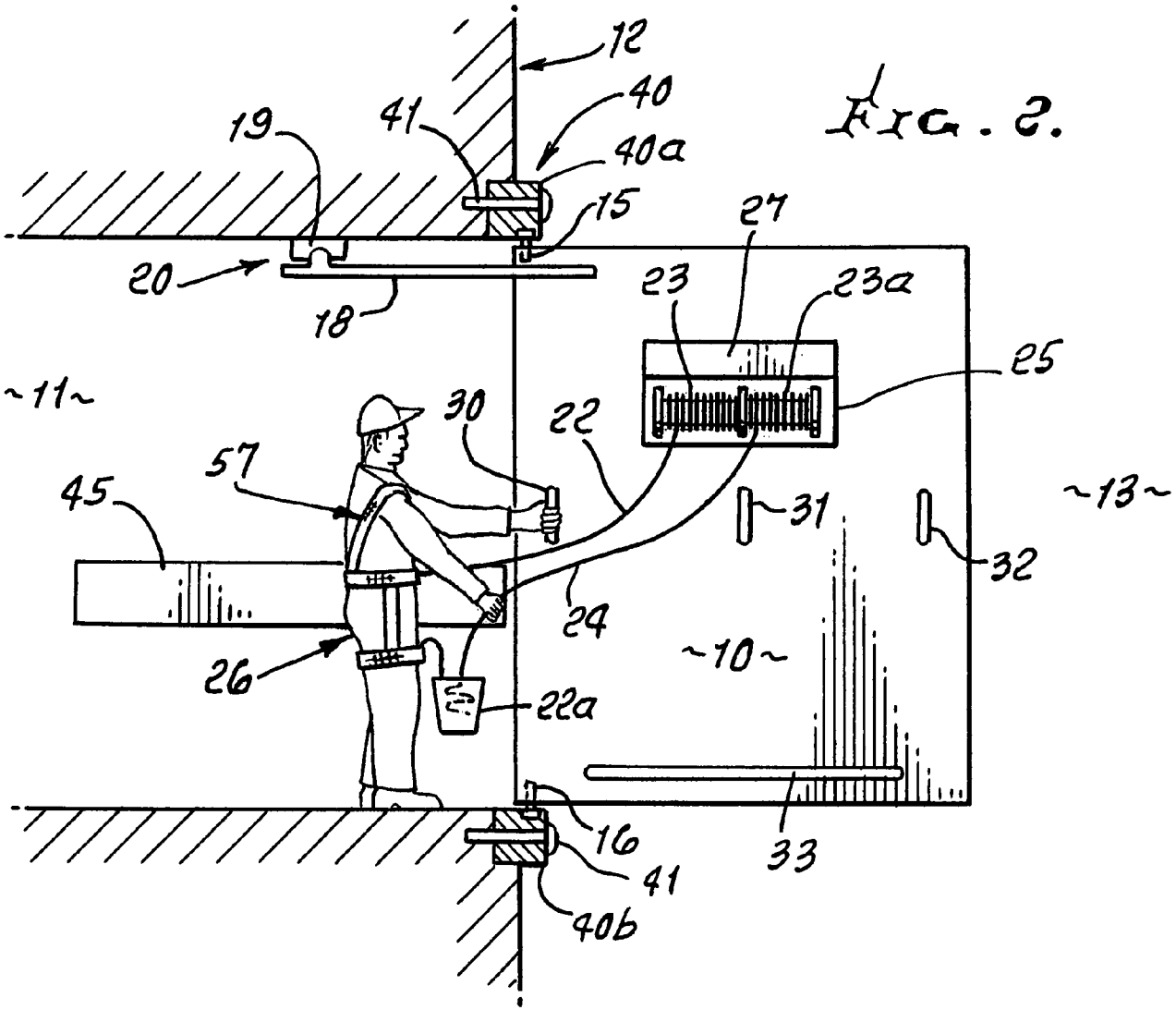
FIG. 2 is a view like FIG. 1, showing the door in open position.
Figure 3:
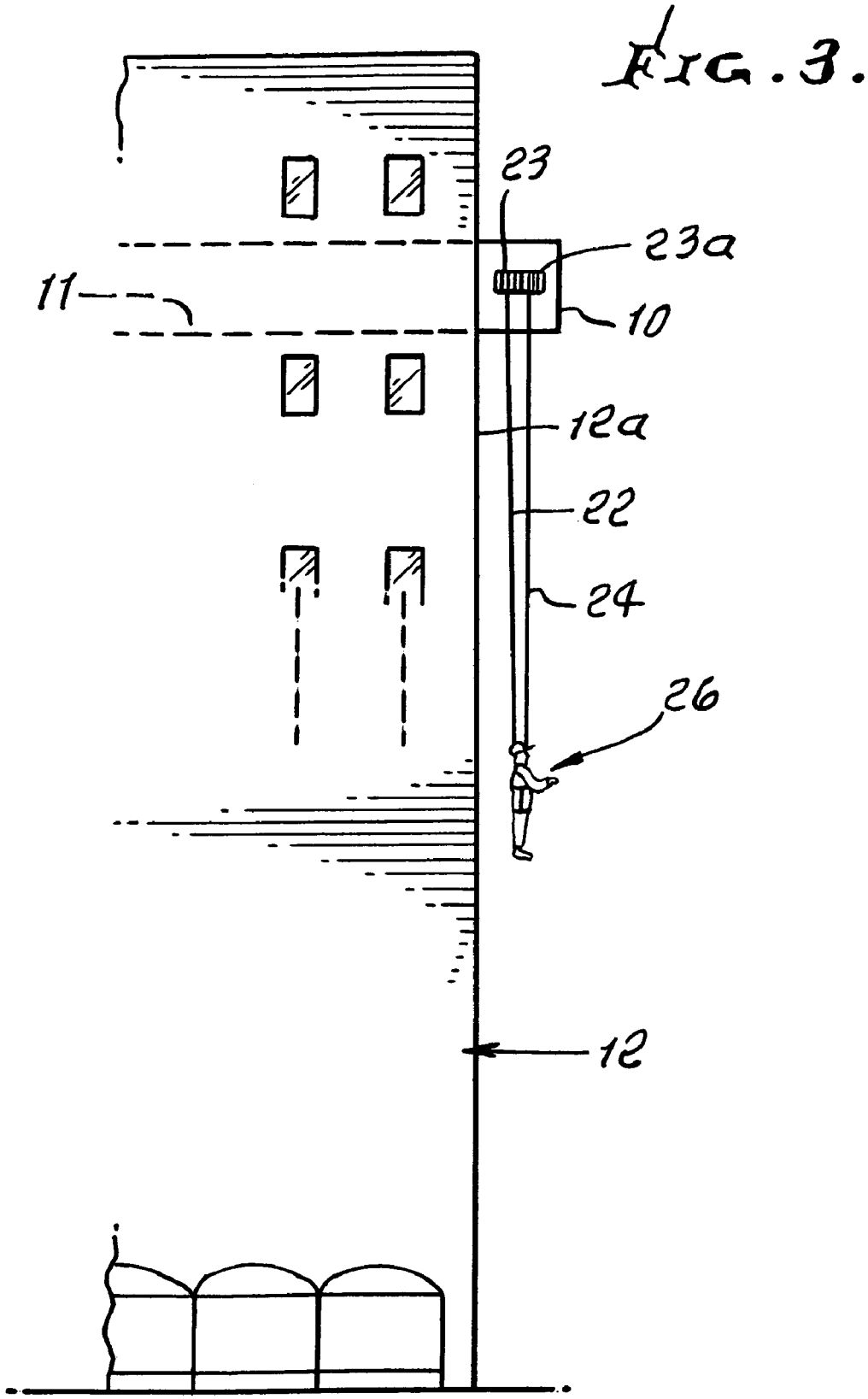
FIG. 3 is an elevation showing descent from a supporting safety door, in open position as in FIG. 2.

The safety door is supported, as by upper and lower hinges 15 and 16, or other means, to open outwardly away from the passage 11, so as to open the passage to the exit and exterior 13. Preferably, the door is opened to a position as seen in FIGS. 2 and 3, projecting in a plane generally perpendicular to the building or to its side 12*a*. The door may be quite heavy, and consist of metal, such as steel. A detent or other holder may be used to hold the door in opened position. See for example detent arm 18 projecting from the door toward and into the passage 11, to interfit a plate 19, at location 20.

Figure 5:
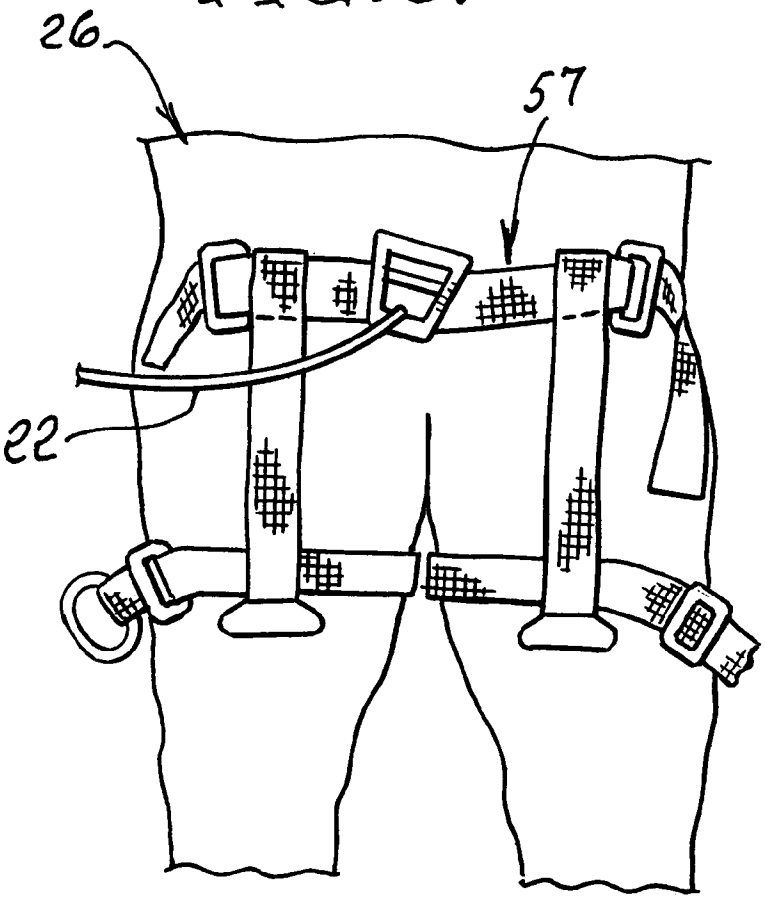
FIG. 5 is a frontal view of cable support of a user.
Figure 9:
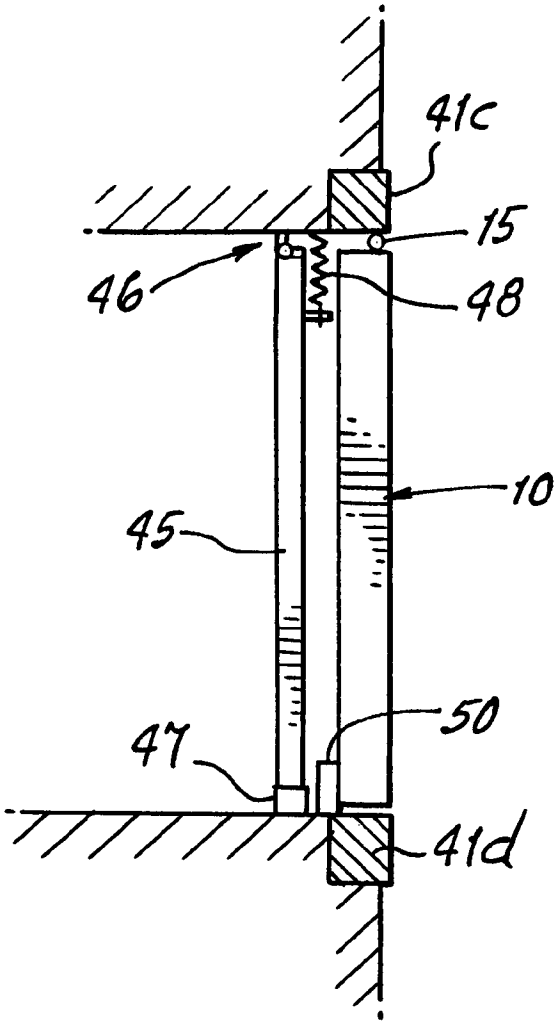
FIGS. 9 and 10 are sections showing location and operation of gearing.

Descent equipment including a cable or cables, is provided for support by the door, and to move outwardly with the door so as to become located above the void below the opened door, at the building exterior 13. In the example, the descent equipment includes support cable 22 extending from a reel or rotor 23 carried by the door at its inner side, and descent control cable 24 extending from that rotor or from a brake or other means indicated at 23*a*, associated with the rotor or reel, and carried by the door, at 25. Referring to FIG. 2, the user 26 accesses the descent equipment as by first attaching a support 57 to his body, as via his clothing, that support connected to support cable 22; preferably, such attachment is made before the door is unlocked and pushed open, to FIG. 2 position. One usable support is shown in FIG. 5. It may also be considered as a harness where the user's pants are the structural member and tightening means, for comfort, and to ensure against user fallout as from the support.

Hand and foot holds or supports are shown at 30–33, attached to the inner side of the door, for use during such stepping to the building exterior. They enable initial positioning of the descent equipment user in a door supported position, directly below the cable reel 23, from which support cable 22 is payed out, under the control of the control cable, by the user. The control cable may be payed out from a container as at 22*a*, which may be attached to the support 57. See also FIG. 3, showing the user descending adjacent the building.

One such support and control system is disclosed in my U.S. Pat. No. 6,186,276, incorporated herein by reference.

FIGS. 1 and 2 also show a rectangular door frame 40 attached as by bolts 41 to the building. The door hinges 15 and 16 may be attached to the upper and lower frame members 40*a* and 40*b*, as shown.

Also provided is a safety barrier barring the person against stepping from the passage to the building exterior, when the door is in opened condition, until the barrier is moved into non-barring position. One such barrier is seen at 45 extending horizontally laterally at the rear side of the door, but rotatably attached to the frame or the building structure. See FIG. 4 showing hinging of the barrier bar at 46, to swing between blocking position, and unblocking position, and a releasable retainer 47 to hold the barrier in blocking position. A spring 48 may be employed to urge the bar to swing toward blocking position. A door lock is shown at 50.

The method of providing for escape from an upper level in a building, includes a) providing a safety door extending between a passage in the building, and the building exterior, the door extending upwardly from a location proximate the passage floor, b) supporting the door to open outwardly away from the passage, in response to inward swinging of an actuator bar to be described, thereby opening the passage to the building exterior, c) providing descent equipment including a cable or cables, for support by the door, and to become located above the void below the opened door at the building exterior, d) whereby a person in that passage may access the descent equipment to be controllably and safely lowered or to travel downwardly into the void at the building exterior, while supported by the door.

Rescue of an occupant wishing to escape from a building, is enabled by provision of the following:

a) providing a safety door to be supported by the building, at a side of the building, b) opening the door away from the side of the building to expose an exit from the building, as by swinging of a barrier bar away from the door opening, c) supporting rescue equipment from the door, d) suspending a rescuer by the rescue equipment, to travel upwardly into proximity to the door, for rescue of the occupant at said exit, as by lowering of the occupant, with or without the rescuer, A support cable may be used to elevate the rescuer to the level of the opened door, and the rescuer can then assist the escape of the person wishing to be rescued, in the manner described above, or to enter the building, for example to suppress a hazard, such as fight a fire. The rescuer and the rescued person can descend together, as by use of separate supports, or a shared support.

Figure 6:
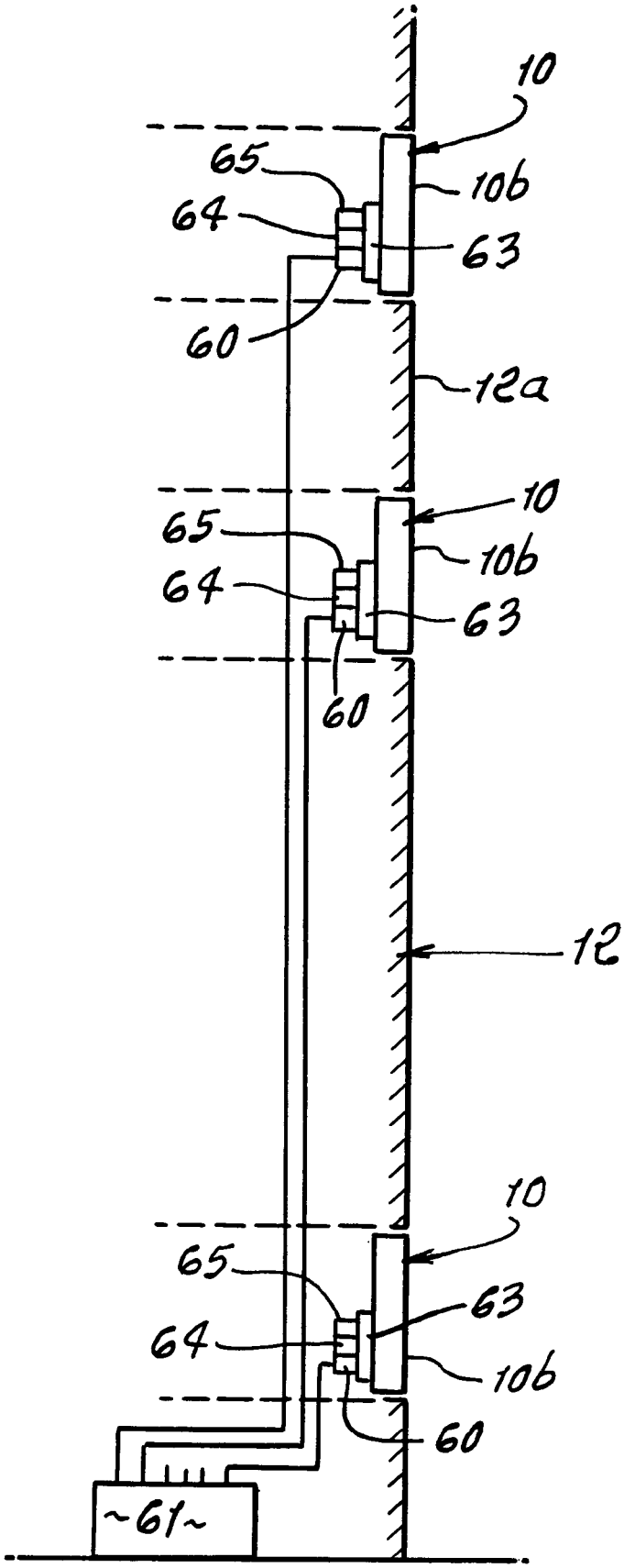
FIG. 6 is a circuit diagram.

FIG. 6 shows a means to enable selective unlocking and opening of different levels in a building. Electrically operated controls to control locks 63 for the doors are indicated at 60; and a master control and circuitry to selectively control the locks is shown at 61. It may, for example, be located at ground level. One advantage is that only those doors at danger level, such as a fire, are enabled to be unlocked, all other safety doors in the building being kept locked.

Smoke responsive controls may be provided, as at 64, to unlock the locks 63, allowing opening of the doors 10.

Manually operated controls may be provided, as at 65, to unlock the locks 63, allowing opening of the doors, irrespective of the controls 60 and 64.

FIG. 6 also shows the closed door outer surfaces 10*b* extending flush, or substantially flush with the building outer surface 12*a*.

FIGS. 7–11 illustrate preferred door escape apparatus 100, which is manipulated in such a way as to effectively obstruct exiting by a user through the door opening 101 as the door 102 is swung outwardly toward fully open position, thereby enhancing safety. Such apparatus basically includes a first bar or barrier 103 at a side of the door opposite the building exterior, such that the bar 103 extends between the door and the user 114 during door opening; together with means indicated generally at 105 operatively connecting the bar 103 to the door whereby pivotal swinging of the bar in a rearward direction away from the door causes the door to swing forwardly toward an open position.

An attachment of the descent line 171 to the door is shown at 212.

The means 105 may advantageously include gearing having first and second axes of rotation. See in FIGS. 9 and 10 for example spur gear 107 rigidly connected to the bar end portion 103*a*, and having a vertical axis of rotation 108; and spur gear 109 meshing with gear 107, and rigidly connected to the door vertical edge portion 102*a*, and having a vertical axis of rotation 110. Axes 108 and 110 are shown as extending in offset, parallel relation. Other forms of gearing can be employed. The arrangement shown is such that as bar 103 is pulled inwardly toward the building or hallway interior (see arrow 112 in FIGS. 8 and 9, the door 102 is swung outwardly toward the building exterior (see arrow 113 in FIGS. 8 and 9. Note a user, depicted at 114, manually at 114*a* pulling on the bar, which extends between the user and the door opening 101. Since pulling is necessary, the user remains at the "safe" side of the bar, to exert pulling force, and he is blocked against access to the door opening 101 as the door is swung away from opening 101 in a direction opposite to bar movement. A bar locking mechanism is seen at 210 and is unlocked for bar use.

Figure 7:
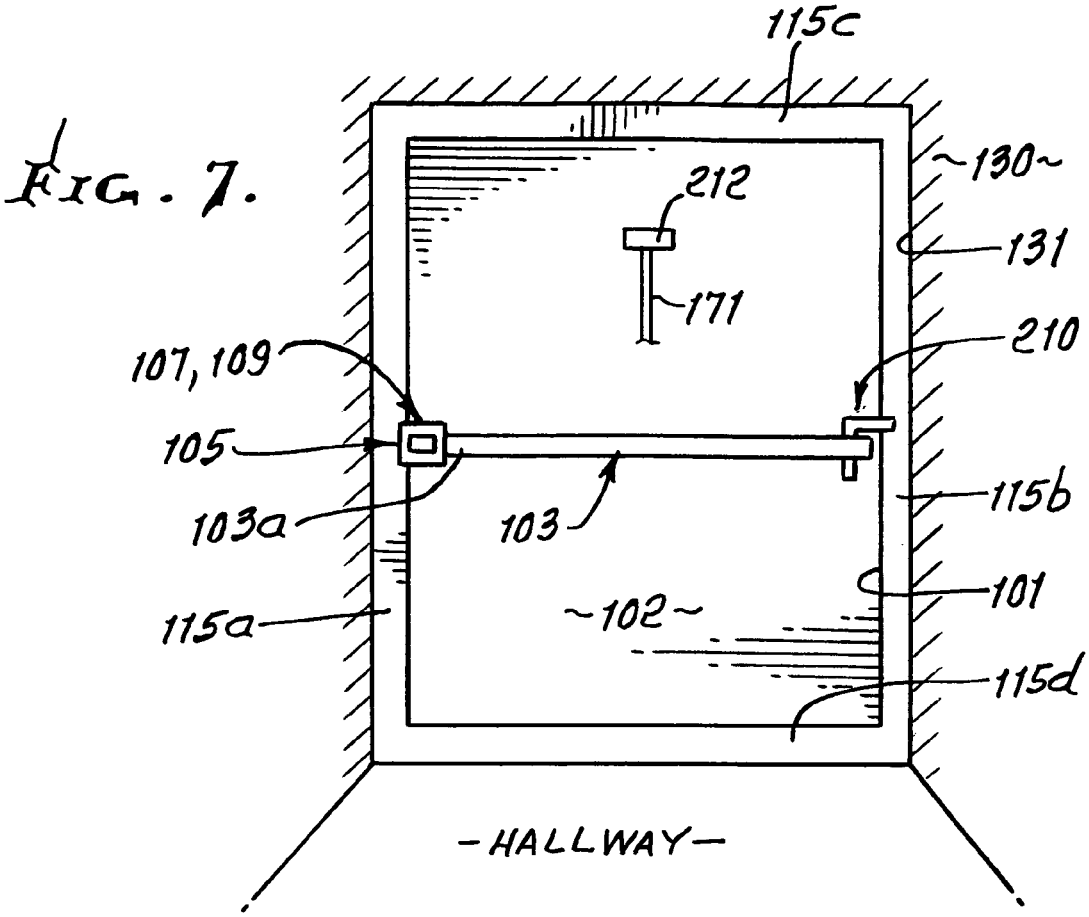
FIG. 7 is an elevation showing a door, for a door opening bar.
Figure 8:
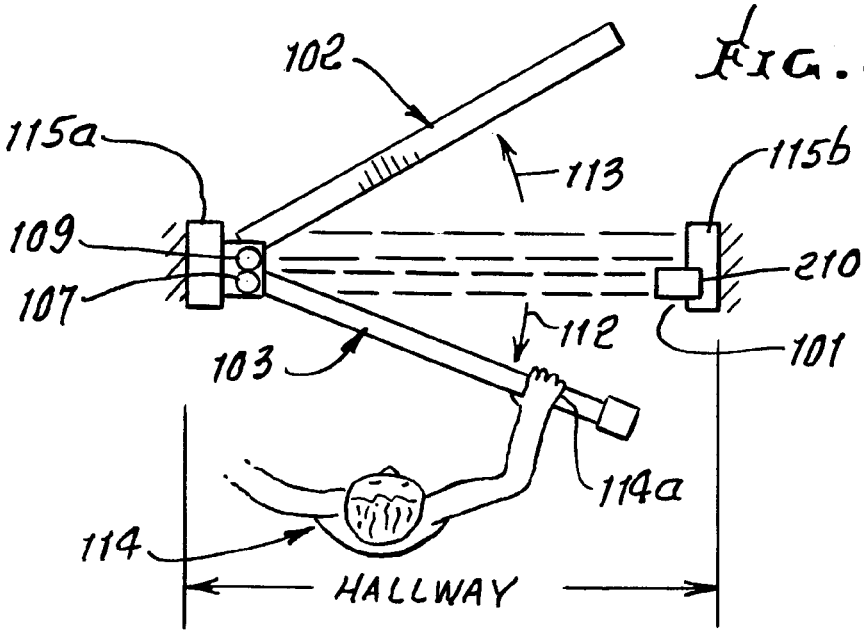
FIG. 8 is a plan view showing a door being opened.
Figure 9:
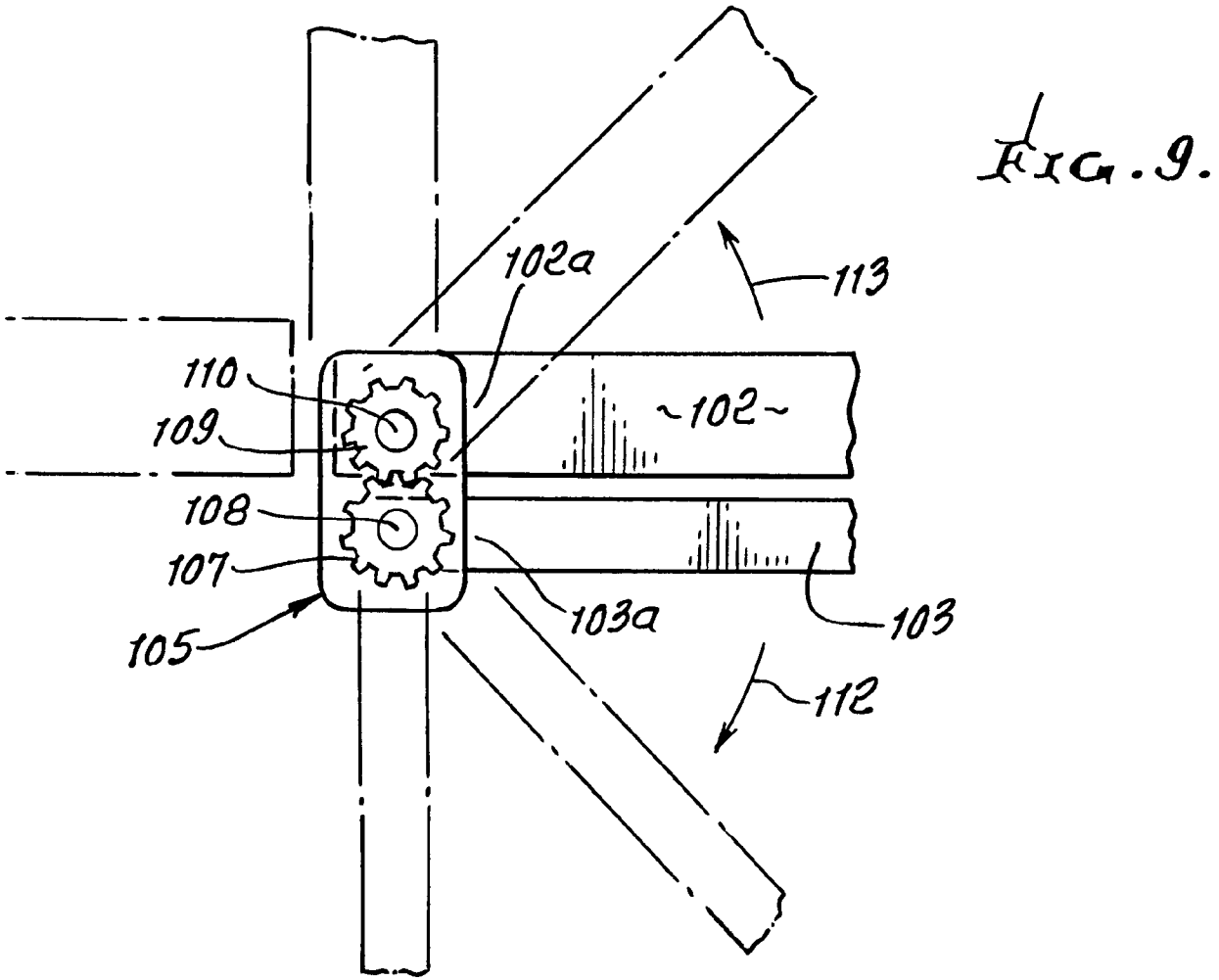
Figure 10:
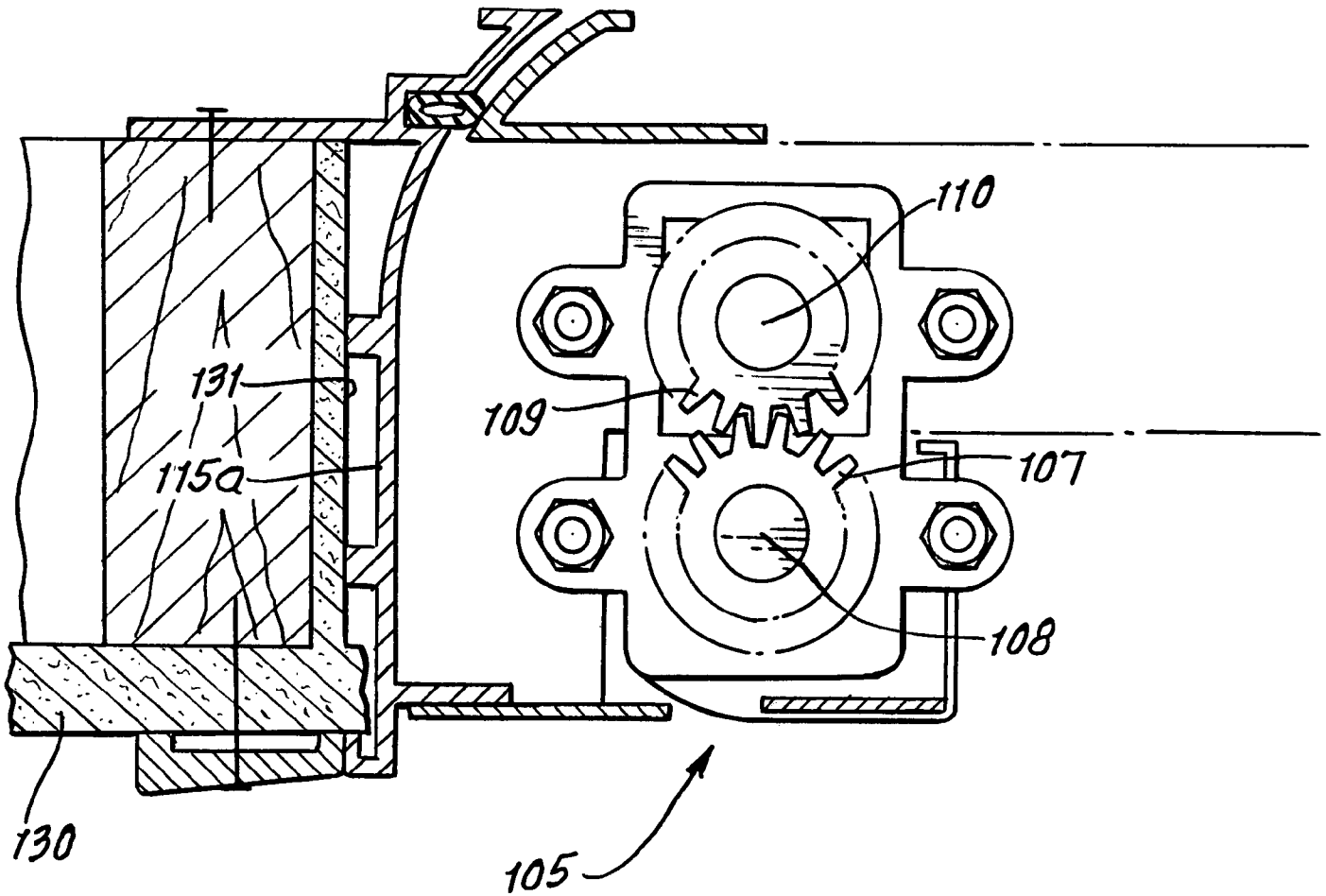

FIG. 7 also shows use of a rectangular casement 115, with upright members 115*a* and 115*b*, and horizontal members 115*c* and 115*d*, and together defining the through opening 101 which is closed and opened by the door 102 in various door positions. The door is swung forwardly away from the casement, toward fully open positions as seen in FIG. 11, as the bar is swung rearwardly toward corresponding inwardly directed position. That position need not be perpendicular to the plane of the casement, but can be for example in positions as indicated by broken lines 103*c* or 103*d* in FIG. 11. Also the gearing may be such as to provide for a lesser or greater angular swinging of the door as compared with angular swinging of the bar 103.

FIG. 12 shows casement upright 115*a* supporting the door 102, via hinge member 121 fixedly carried by 115*a*. A vertical axle or pin 120 carried by the door pivots in the hinge member 121, and defines axis 110. Spur gear 109 is fixedly carried by the pin 120, to rotate about axis 110. Accordingly, both the door and gear 109 rotate about axis 110. FIG. 13 shows upright 115*a* supporting the bar 103, via hinge member 124 fixedly carried by 115*a*. A vertical pin 125 carried by the bar pivots in the hinge member 125, and defines axis 108. Spur gear 107 is fixedly carried by pin 125, to rotate about axis 108, with the bar. Accordingly, both the bar 103 and the gear 107 rotate about axis 108. Axes 108 and 110 are parallel, and vertical.

FIG. 7 also shows a building upright wall 130 defining an opening 131 into which the casement 115 fits. Wall opening 131 is in registration with the casement defined door opening 101. The casement 115, door 102, bar 103, and gearing 107 and 109 may be provided as a commercial unit, and such units may be fitted into multiple wall openings 131 in a building, to provide safe egress at selected locations and floor levels.

Figure 14:
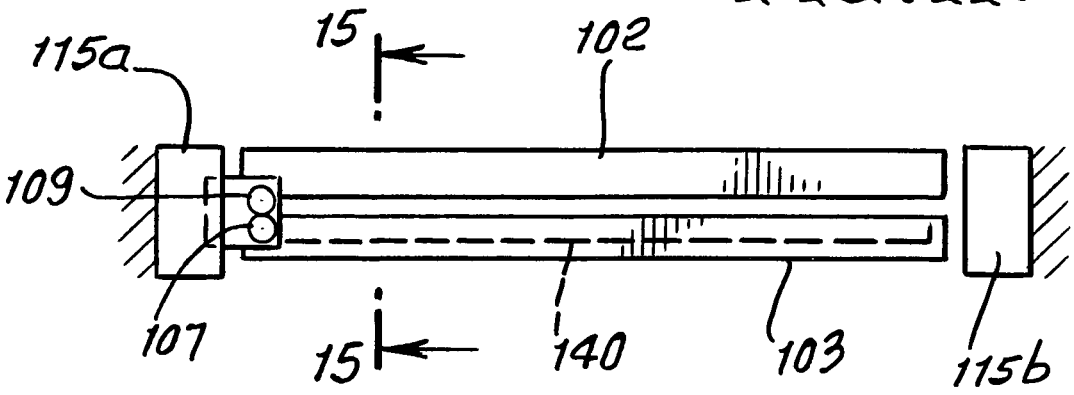
FIG. 14 is a view like FIG. 7, but showing use of a second barrier bar.
Figure 15:
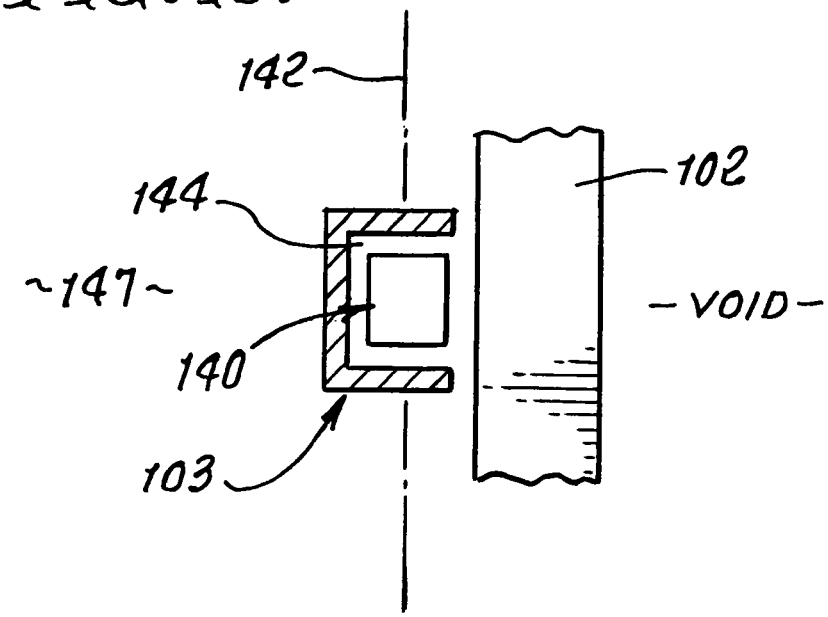
FIG. 15 is a section taken on lines 15—15 of FIG. 14.

An additional and optional feature of the invention is the provision of a second bar or barrier which has a position extending crosswise of said casement opening during swinging of the door toward said open position, to block user egress through said casement opening until the user is prepared for safe descent after egress through said opening. That barrier may take the form of a second bar, carried by the casement to be closely associated with the first bar prior to rearward swinging of the first bar as described above. The second bar is operable to be pivoted after the first bar has been swung rearwardly, allowing the user to egress through the casement opening. See for example the second bar 140 extending transversely relative to the casement opening 101 in FIG. 14, proximate the first bar 103, but independently supported at 141, at the end of the bar 140, to be swung independently of bar 103 about a vertical axis 142 seen in FIG. 15. The second bar may be at least partially housed or concealed by the first bar, in initial positioning of those bars. See FIG. 15, showing an elongated recess 144 in bar 103, receiving bar 140 in a concealed position as related to a user at location 147 in the building hallway. Thus, the user cannot inadvertently swing bar 140 to open position prior to swinging bar 103 to open position, protecting the user against egress (whatever the position of bar 103) until bar 140 is swung open.

Figure 16:
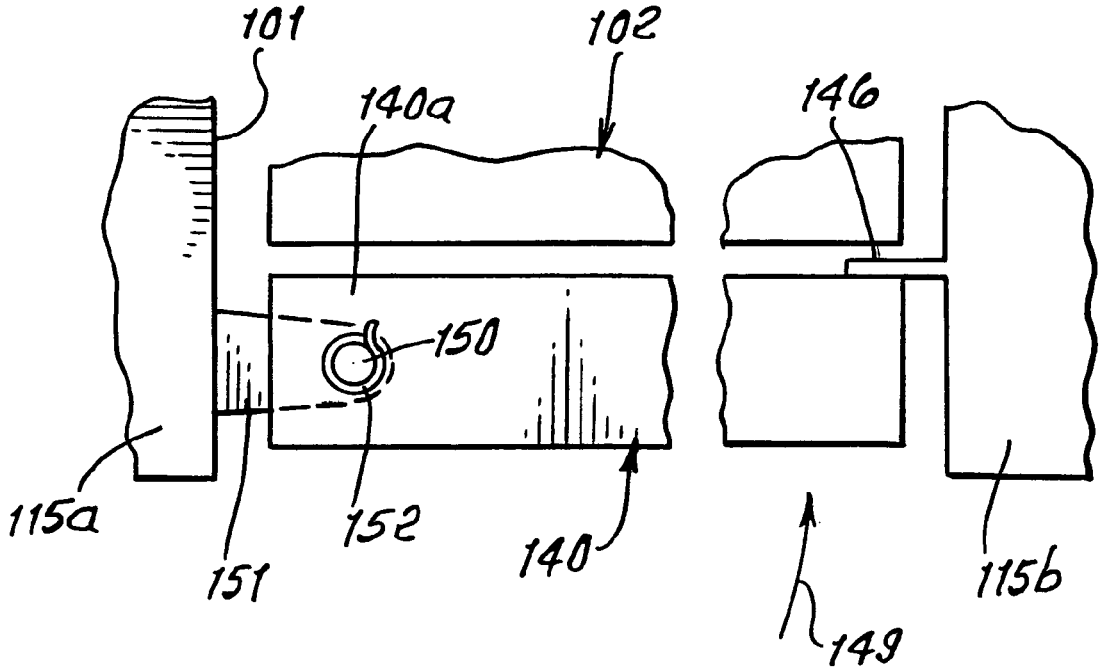
FIG. 16 is a view showing a spring acting on the second bar.

FIG. 16 shows pivoting at 150 of the end 140*a* of the second bar 140 to a support 151 carried by the casement. A spring, such as a torsion spring 152 acts as a yieldable return, to urge the second bar 140 in a direction indicated by arrow 149 back toward initial position, extending transversely across, or partly across the casement through opening 101 and against a stop 146.

Figure 17:
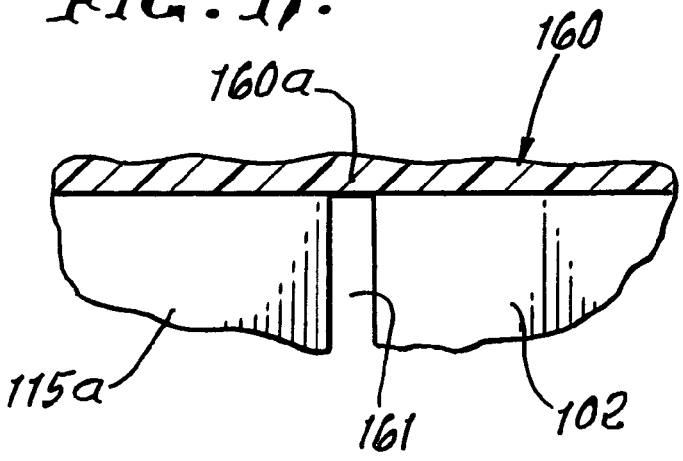
FIG. 17 shows facing material on the door.

FIG. 17 shows optional use of a protective layer of material 160 (such as plaster or glass) extending over the casement and the door, at the side of the closed door facing outwardly or forwardly. That layer, preferably extends at 160*a* across a gap or gaps as at 161 between the door and the casement 115. Material extent 160*a* is frangible to crack open as the door is swung outwardly, as described herein.

Figure 19:
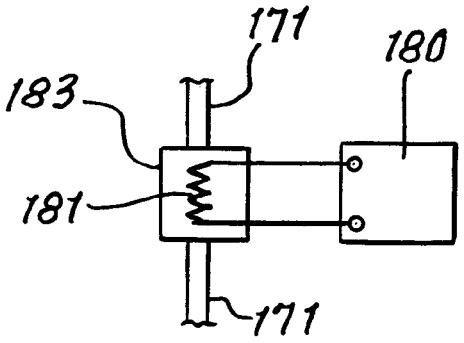
FIG. 19 shows an overload indicator associated with the descent line.

Additional usable features include the following:

1) A user descent enabling means 170 to be carried by the door at its inner side, to support a person for descent relative to the door. See for example the traveler 170*a* that frictionally grips and travels downwardly (slides) along line 171, at a controlled rate, and that safely supports the user as he descends.
2) A kinetic energy dissipating device acting to slow descent of said carrier travel on and along said line. Such a device may include energy transfer rotors indicated at 174 rotatable in a fluid to which kinetic energy is transferred to heat said fluid.
3) Means 176 to store the descent line at or near the inner side of the door, in an edifice.
4) An excess weight warning device 177 carried by the door to be responsive to weight of said line and of a user or users descending via said line, to warn when weight applied to the door by the line and user or users exceeds a predetermined limit. Intending users are thereby warned not to descend until such warning is removed by removal of a descending user or users weight from the line at street level. Such a device may for example include circuitry 180 connected to a bonded wire strain gage 181 affixed to line support 183, as seen in FIG. 19. Stretching of the gage changes its resistances in circuit. Another such device may include a spring which stretches corresponding to movement of a pointer. FIG. 19 may also be considered to represent this.

Figure 20:
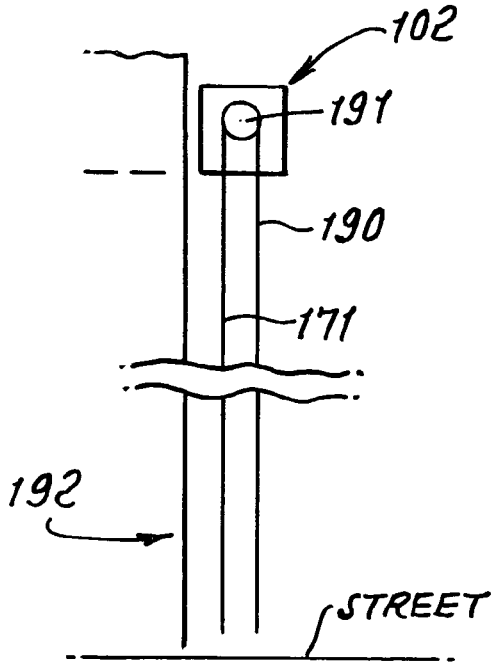
FIG. 20 is a schematic showing use of two lines, as for ground control of rescue at door level.

6) A second line 190 spooled at 191 in FIG. 20, and in conjunction with spooling of the descent line 171, at or proximate the door whereby when either of said lines is pulled downwardly from a lower level location 192, the other of said lines is pulled upwardly toward the door, whereby a rescuer may be carried upwardly by said other line toward the door.

6) A holder 195 operating to hold the door in open position, projecting away from the building wall. See for example holder 98, in FIG. 11, of sufficient strength to hold the door open despite very high wind loading of the door.

The basic method of opening an egress door at the wall of a building, at an elevation above ground includes the steps:

a) providing a bar at one side of the door, b) providing means connecting the bar to the door so that the door opens when the bar is swung, c) and pivotally swinging the bar in a rearward direction away from the door so as to cause the door to swing forwardly toward open position, and while remaining substantially vertical.

Additionally, the method may include providing a door casement to be carried by the building wall, the casement defining a door opening that is closed by the door before the bar is swung, and that is opened in response to bar swinging, rearwardly.

Additional steps, may include:

i) providing the barrier in the form of a second bar closely associated with said first bar prior to said rearward direction swinging of the first bar.

ii) providing the second bar to swing relative to a casement defining a door opening that has been opened by the door, thereby allowing the user to egress through the casement opening.

iii) causing the second bar to be at least partially confined by the first bar prior to door opening, so that the second bar remains in position to act as a barrier in registration with said opening, as the first bar is swung rearwardly to open the door.

iv) applying a protective but frangible layer extending over an outer side of the casement and over the outer side of the door, whereby opening of the door causes the layer to be broken at gaps between the door periphery and the casement.

v) providing descent enabling means carried by the door to support a person to safely descend relative to the open door.

vi) providing a carrier to be supported by said line and to be capable of traveling downwardly along and relative to said line.

vii) providing a kinetic energy dissipating device for slowing descent of the carrier travel in and along the line.

viii) providing an excess weight warning device carried by the door to be responsive to weight of said line and of a user or users descending via said line, to warn when weight applied to the door by the line and user or users exceeds a predetermined limit, whereby intending users are warned not to descend until such warning is removed by removal of a descending user or users from the line, upon descent completion at street level.

ix) providing a second line, and providing for spooling of said descent line and second line at or proximate the door whereby when either of said lines is pulled downwardly from a lower level, the other of said lines is pulled upwardly toward the door, whereby a rescuer may be carried upwardly by said other line toward the door, to rescue trapped or hesitant persons in the building.

Figure 18:
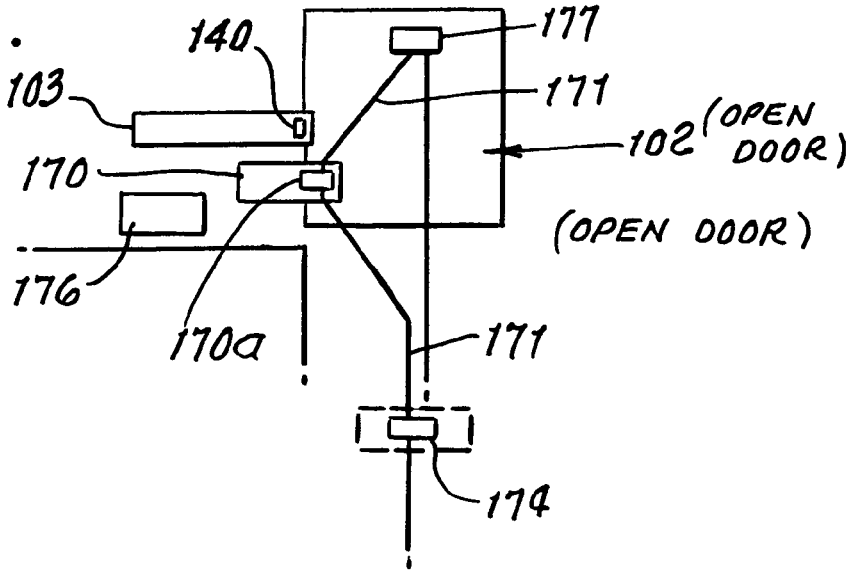
FIG. 18 shows a line traveler.

Referring again to FIG. 18, the method of use may include the following:

a) User pulls back bar 103, to open the door to the position shown. The second bar 140 remains in position extending across the building opening, to bar egress through that opening b) User puts on (steps into) harness, which is connected to descent means 170 in the hallway. (A preferred harness includes a pant or short acting as a primary structural weight bearing member. Appropriate tightening or securing means can be provided, such as buckles or VELCRO).

c) User releases the stored line or lines 171 and 190 from the hallway, to hang at the side of the building, the upper ends of the lines being secured to the door, at 177.

d) User reaches out, over bar 102, to grasp one or both lines 171 and 190; he then attaches the descent means 170 to the line. A safety indicator such as a light indicates completed and safe connection to the line. Lines 171 and 190 can be lightweight and very strong.

e) User then displaces barrier bar 102 rearwardly to enable user egress out the building opening, to be supported by the device 170 as he descends on and relative to the line at a rate controlled by frictional or controlled gripping of the line or by rotation of rotors in fluid, as referred to above.

f) The barrier bar rotates back into egress barring position, so that the next user desiring egress may perform steps b), d) and e) above.

I claim:

1. The method of opening a door at the wall of a building, at an elevation above ground, that includes:

a) providing a bar at one side of the door, b) providing means connecting the bar to the door so that the door opens when the bar is swung, c) pivotally swinging the bar in a rearward direction relatively away from the door so as to cause the door to swing forwardly relatively away from the bar toward open position, and while remaining substantially vertical, d) providing a door casement to be carried by the building wall, the casement defining a door opening that is closed by the door before the bar is swung, and that is opened in response to bar swinging, rearwardly, e) and providing a barrier which has a position extending crosswise of said casement opening during swinging of the door toward said open position, to block user egress through said casement opening until the user is prepared for safe descent after egress through said opening.

2. The method of claim 1 including providing a holder operating to hold the door in open position projecting away from the building wall.

3. The method of claim 1 including connecting said casement to the building wall.

4. The method of claim 1 which also includes the steps:

a) the user connects to a harness which is in turn connected to a descent means, b) the user attaches the descent means to a line hanging from the door, c) the user then displaces the barrier away from said wall opening, d) the user then exits through said opening to be supported by said harness, descent means and line.

5. The method of claim 1 including providing gearing operatively connected to the door and to said casement so as to swing the door forwardly as the bar is swung rearwardly and in a generally horizontal plane.

6. The method of claim 5 wherein the gearing is provided to include two meshing spur gears having vertical axes of rotation, one gear carried by the bar and the other carried by the casement.

7. The method of claim 1 including providing said barrier in the form of a second bar closely associated with said first bar prior to said rearward direction swinging of the first bar.

8. The method of claim 7 including pivoting said second bar to swing relative to said casement defining said door opening that has been opened by the door, thereby allowing the user to egress through the casement opening.

9. The method of claim 7 including causing said second bar to be at least partially confined by the first bar prior to door opening, so that the second bar remains in position to act as a barrier in registration with said opening, as the first bar is swung rearwardly to open the door.

10. The method of claim 9 including providing a spring positioned to yieldably urge the second bar toward said barrier position.

11. The method of opening a door at the wall of a building, at an elevation above ground, that includes:

a) providing a bar at one side of the door, b) providing means connecting the bar to the door so that the door opens when the bar is swung, c) pivotally swinging the bar in a rearward direction away from the door so as to cause the door to swing forwardly toward open position, and while remaining substantially vertical, d) providing a door casement to be carried by the building wall, the casement defining a door opening that is closed by the door before the bar is swung, and that is opened in response to bar swinging, rearwardly, e) and including applying a protective but frangible layer extending over an outer side of the casement and over the outer side of the door, whereby opening of the door causes the layer to be broken at gaps between the door periphery and the casement.

12. The method of opening a door at the wall of a building, at an elevation above ground, that includes:

a) providing a bar at one side of the door, b) providing means connecting the bar to the door so that the door opens when the bar is swung, c) pivotally swinging the bar in a rearward direction away from the door so as to cause the door to swing forwardly toward open position, and while remaining substantially vertical, d) and including providing descent or ascent enabling means carried by the door to support a person to descend or ascend relative to the open door.

13. The method of claim 12 including providing a descent or ascent means line to be hung from the door in open position.

14. The method of claim 13 including providing a carrier to be supported by said line and to be capable of traveling downwardly along and relative to said line.

15. The method of claim 14 including providing a kinetic energy dissipating device for slowing descent of the carrier travel in and along the line.

16. The method of claim 14 including providing an excess weight warning device carried by the door to be responsive to weight of said line and of a user or users descending via said line, to warn when weight applied to the door by the line and user or users exceeds a predetermined limit, whereby intending users are warned not to descend until such warning is removed by removal of a descending user or users from the line.

17. The method of claim 13 including providing a second line, and providing for spooling of said descent line and second line at or proximate the door whereby when either of said lines is pulled downwardly from a lower level, the other of said lines is pulled upwardly toward the door, whereby a rescuer may be carried upwardly by said other line toward the door.

* * * * *